United States Patent [19]

Dalton

[11] 4,280,724

[45] Jul. 28, 1981

[54] SPRING LATCH

[75] Inventor: John Dalton, Yardley, Pa.

[73] Assignee: Keystone Lighting Corp., Bristol, Pa.

[21] Appl. No.: 66,872

[22] Filed: Jun. 15, 1979

[51] Int. Cl.[3] ..... E05C 19/06

[52] U.S. Cl. ..... 292/87

[58] Field of Search ..... 292/80, 87, 88, 89, 292/19, 20, 84

[56] References Cited

U.S. PATENT DOCUMENTS

| | | | |
|---|---|---|---|
| 417,619 | 12/1889 | Woodard | 292/87 |
| 2,007,866 | 7/1935 | Lang | 292/87 X |
| 2,084,717 | 6/1937 | Wiley . | |
| 2,144,885 | 1/1939 | MacFadden . | |
| 2,159,445 | 5/1939 | Murphy | 292/87 |
| 2,451,591 | 10/1948 | Tinnerman et al. . | |
| 2,520,725 | 8/1950 | Judd . | |
| 2,698,472 | 1/1955 | Knohl . | |
| 2,809,413 | 10/1957 | Wootton . | |
| 3,063,115 | 11/1962 | Van Buren, Jr. . | |
| 3,205,546 | 9/1965 | Nelson . | |
| 3,556,572 | 1/1971 | Olsson | 292/87 |

*Primary Examiner*—Richard E. Moore

*Attorney, Agent, or Firm*—Walter B. Udell

[57] ABSTRACT

A one piece spring latch having a camming surface engageable by the edge of a cooperating latching aperture to deflect the latch element until it passes through the aperture to latching position, the latch element then snapping into overlying latching engagement with the material forming the bounding edge of the latching aperture.

The latch is particularly suitable for latching together substantially co-planar panels disposed closely adjacent to one another, as for example the diffuser frame and housing of a fluorescent lighting fixture, a portion of the latching device being of thin cross section and extending between the edges of the panels so that very little clearance between the adjacent panel edges is required. The latch includes release tabs which are physically small and are easily operable by finger pressure. The latch element is securable by means of a single fastener and includes a tail projection which is extendable through a cooperating aperture to render the latch element non-rotatable if the fastener element should become loosened so that the latch element cannot jam or twist under extended use conditions.

9 Claims, 7 Drawing Figures

FIG.6
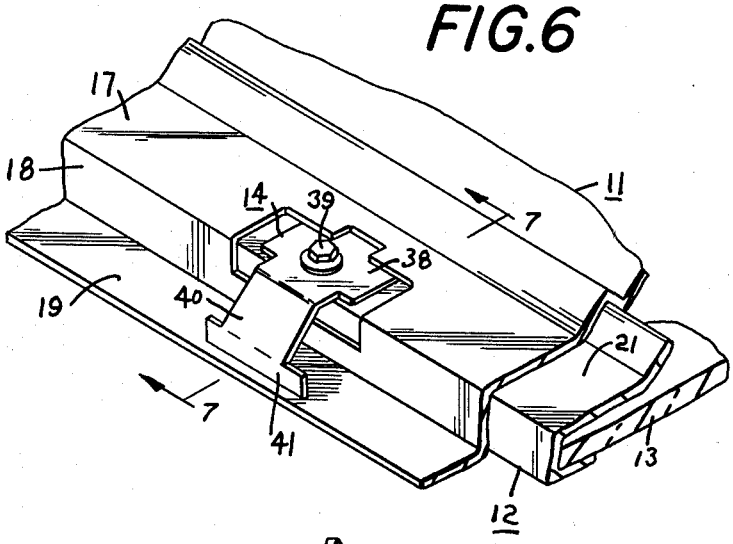
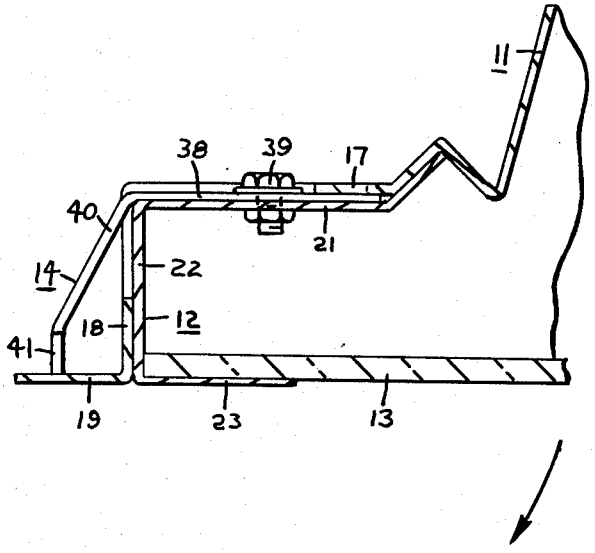
FIG.7

SPRING LATCH

This invention relates generally to spring latches, and more particularly relates to a novel one-piece latch element having a camming surface engageable by the edge of a cooperating latching aperture to deflect the latch element until it passes through the aperture to latching position, the latch element then snapping into overlying latching engagement with the material forming the bounding edge of the latching aperture.

The latch according to the invention is particularly suitable for latching together substantially co-planar panels disposed closely adjacent to one another, a portion of the latching device being of thin cross section and extending between the edges of the panels to that very little clearance between the adjacent panel edges is required. One use application for the novel spring latch according to the invention is as an unobtrusive latch for securing the diffuser frame of a fluorescent lighting fixture to the above lying housing. In such an application, the latch release tabs are physically small, closely underlying the diffuser frame, and are easily operable by finger pressure to release the frame from the housing so that it may be swung downward out of the way for relamping the fixture. The latch element is securable to the frame by means of a single fastener and includes a tail projection which is extendable through a cooperating aperture to render the latch element non-rotatable if the fastener element should become loosened so that the latch element cannot jam or twist under extended use conditions.

A primary object of the invention is to provide a novel spring latch suitable for securing adjacent or mating structural sections together in releasable fashion.

Another object of the invention is to provide a novel spring latch as aforesaid in which the latch is characterized by a thin section which is disposable between closely adjacent surfaces of the structures to be connected together.

A further object of the invention is to provide a novel spring latch as aforesaid wherein the latch element is securable to one of the structures to be releasably interconnected by means of a single fastener in a non-rotatable or non-shiftable position.

The foregoing and other objects of the invention will become clear from a reading of the following specification in conjunction with an examination of the appended drawings, wherein:

FIG. 6 is a partial sectional isometric view of the hinge structure shown in FIG. 1; and FIG. 7 is a vertical sectional view on an enlarged scale through the hinging region of the fixture as would be seen when viewed along the line 7—7 of FIG. 6.

In the several Figures, like elements are denoted by like reference characters.

Figure 2:
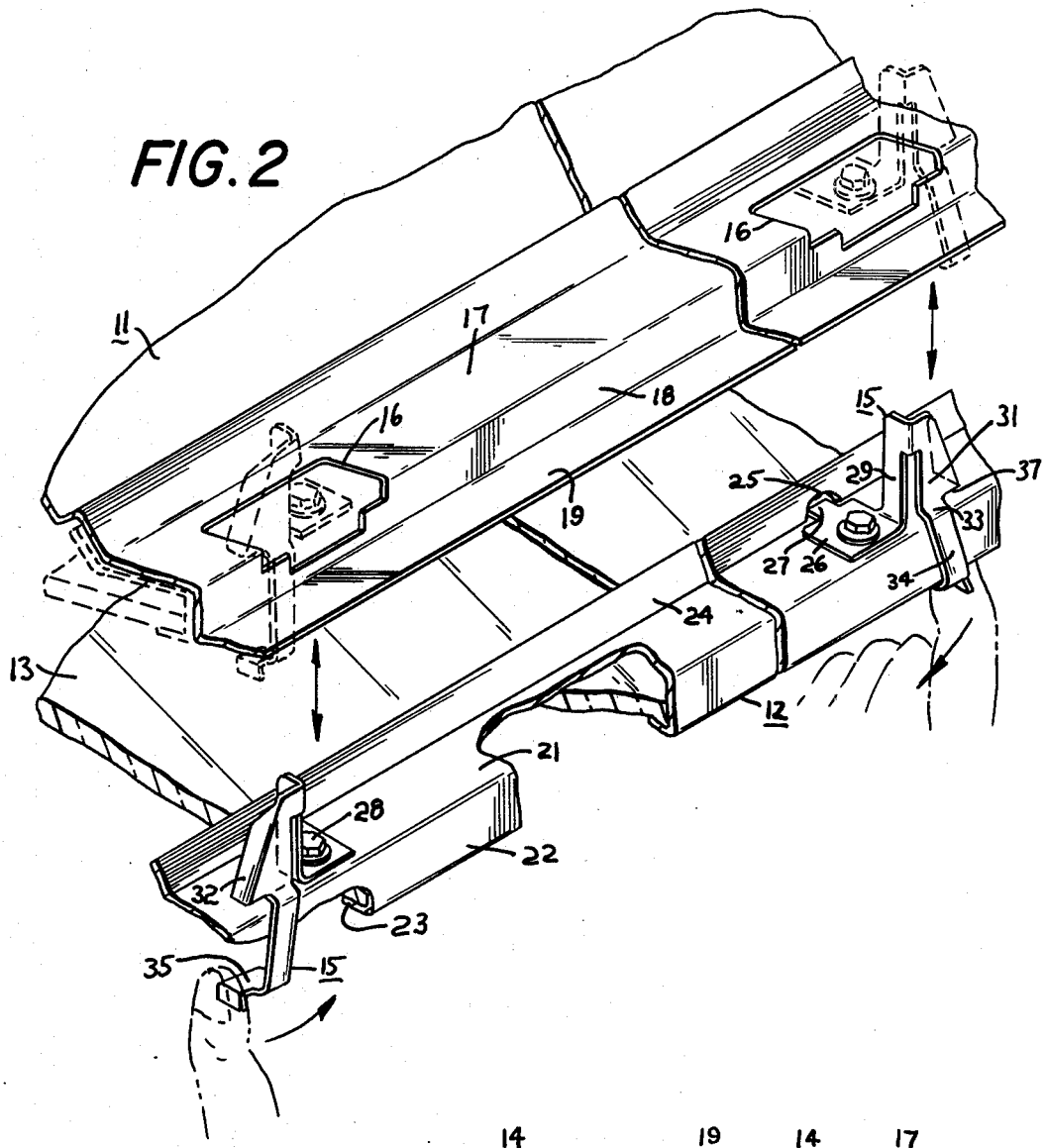
FIG. 2 is a fragmentary view of a portion of the housing and diffuser structure shown in FIG. 1, the diffuser frame being illustrated in solid line as disengaged and partly swung downward below the housing, and being shown in dotted line in latched operative position.
Figure 1:
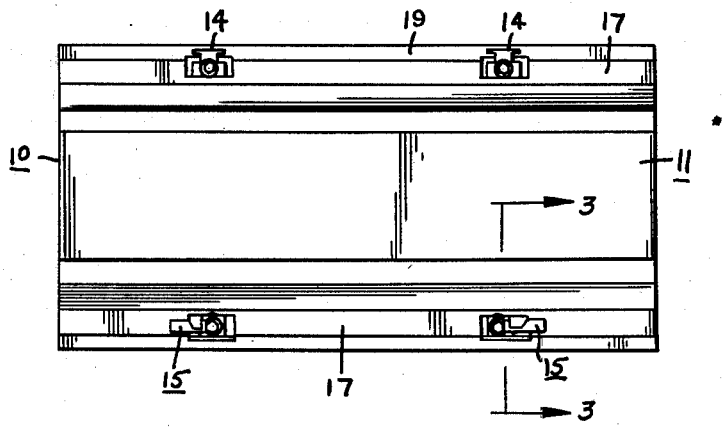
FIG. 1 is a top view of a fluorescent light fixture showing the housing, hinges and latches, from above, which secure the diffuser frame to the above-lying housing.

Referring now to the drawings, there is seen a lighting fixture designated generally as 10 comprising an upper housing 11 and an underlying diffuser frame 12 being pivotally carried along one edge by the housing 11 by means of a pair of hinges 14 secured to the diffuser frame 12, and being latched along the opposite edge of the diffuser frame 12 to the housing 11 by means of a pair of spring latches 15 secured to the diffuser frame, and which latch through apertures 16 cut through a portion of the housing 11.

Figure 3:
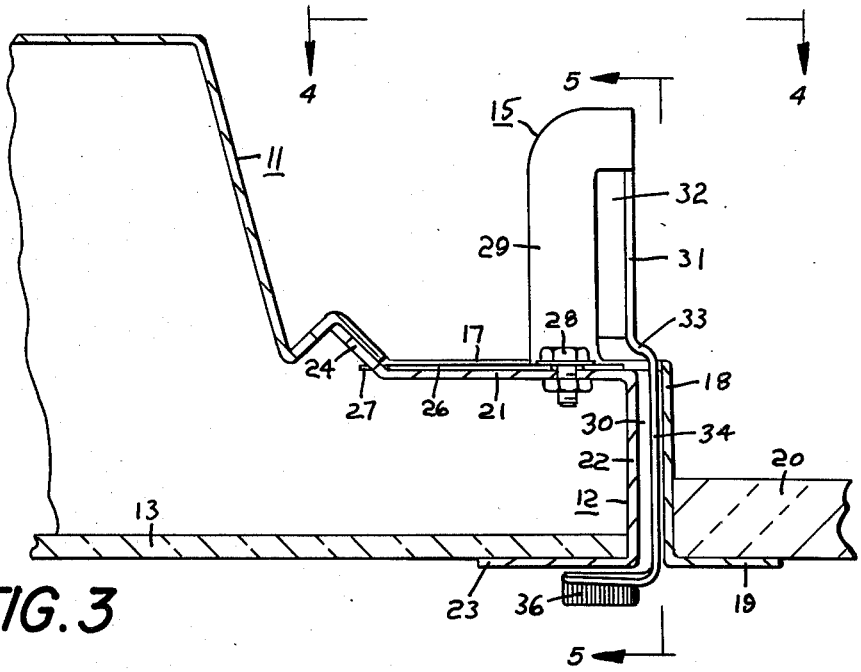
FIG. 3 is a partial vertical sectional view on an enlarged scale through a portion of the structure shown in FIG. 1 immediately adjacent to one side of the novel spring latch according to the invention, as would be seen when viewed along the line 3—3 of FIG. 1.

As best seen in FIGS. 2 and 3, the housing 11 has a longitudinally extending horizontal side surface 17 from which vertically depends a side edge 18 and from the lower edge of which longitudinally extends an outwardly turned horizontal flange 19 which provides support for one edge of a ceiling panel 20 into which the lighting fixture is recessed. The diffuser frame 12 is generally J shaped in cross-section having an upper horizontal leg 21 seatable flatwise upward against the underside of the housing horizontal surface 17, a vertical leg 22 extending downward from the outer edge of the diffuser frame horizontal leg 21 and in parallel spaced away relationship from the housing vertical side edge 18, and a diffuser frame horizontal bottom edge 23 extending inward from the bottom edge of the vertical leg 22 and substantially in plane with the housing horizontal bottom flange 19. Extending inward and upward from the inner edge of the diffuser frame upper horizontal leg 21 is a longitudinally extending upper terminating portion 24. As best seen in FIG. 2, an aperture 25 is punched or otherwise cut through the diffuser frame upper terminating portion 24 just above its juncture with the upper horizontal leg 21 and immediately adjacent to the location of the spring latches 15.

In the illustrated use application, the two spring latches 15 are mirror images, although it will be appreciated that in other applications only one latch or a different arrangement might be more suitable. Each of the spring latches is cut and formed from a single piece of resilient material, such as an appropriate gauge of spring steel or phosphor bronze. Each latch is formed with a base plate 26 from which inwardly extends a tail piece 27, the tail piece extending along the upper surface of the diffuser frame upper horizontal leg 21 and through the aperture 25 in the frame upper terminating portion 24. The latch is secured to the diffuser frame upper leg 21 by a nut and bolt 28. The aperture 25 shown in FIG. 2 is illustrated as oversize in order to provide clarity in the drawing. However, the width of the aperture is only sufficient to permit projection of the latch base tail piece 27 therethrough. This arrangement prevents rotation of the latch 15 which is secured to the diffuser frame by the nut and bolt 28.

Extending perpendicular and upward from one side edge of the base plate 26 is resilient leg 29, the thin dimension of the leg 29, which corresponds to the direction of resilience, being substantially orthogonal to the direction of the tail piece 27 and parallel to the longitudinally extending direction of the slot 30 constituting the space between the housing vertical side edge 18 and the diffuser frame vertical leg 22. Vertical resilient leg 29 turns at its upper end orthogonally away from the base plate 26 and merges with a vertically downwardly extending leg 31 whose plane is disposed at right angles to the plane of the leg 29 with the plane of the leg 31 being parallel to and disposed offset above the slot 30. The edge 32 of the leg 31 which is remote from the leg 29 diverges from the plane of the leg 29 in the direction of the extent of the edge 32 from its upper end to its lower end. This edge 32 of the leg 31 is formed from a folded over piece of the material forming a broad camming surface which is engageable with one of the edges of the housing latch aperture 16 associated therewith. The leg 31 at about the level of the latch base plate 26 turns outward for a short distance, as at 33, and then continues downward, as at 34, through the slot 30 to a point just below the level of diffuser frame horizontal bottom edge 23, at which point it turns inward under the frame horizontal leg 23, as at 35, and terminates in a down-turned finger tab 36.

Figure 5:
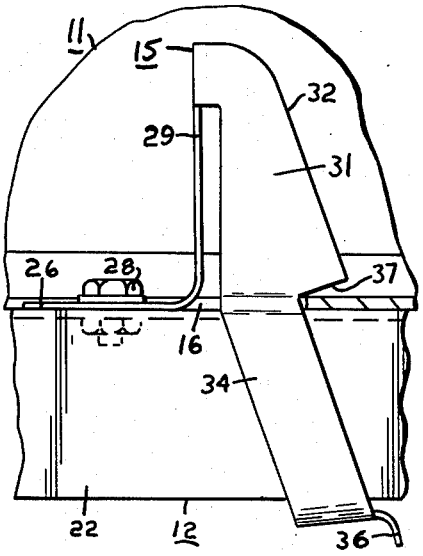
FIG. 5 is a side view of the novel spring latch according to the invention as would be seen when viewed along the line 5—5 of FIG. 3.
Figure 4:
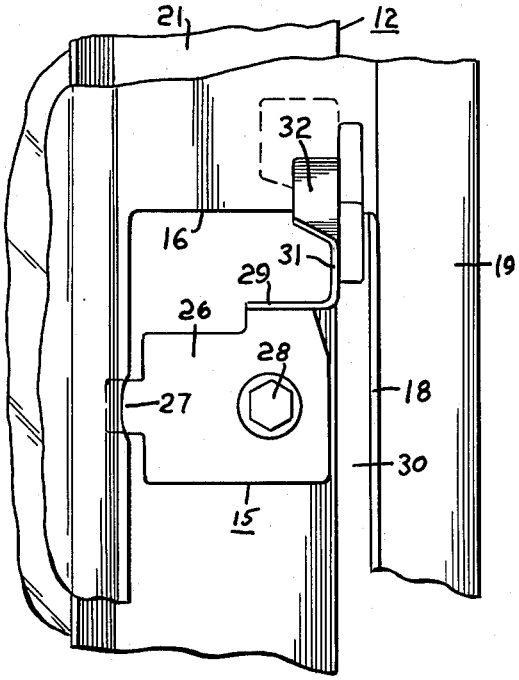
FIG. 4 is a plan view of the spring latch according to the invention as would be seen when viewed along the line 4—4 of FIG. 3.

The leg 31 in the outturned region 33 is of lesser width than at the lower end of camming edge 32 which terminates vertically somewhat above the outturn 33. The narrower width region 33 is joined to the lower end of camming edge 32 by an upwardly sloped latching edge 37, this being best seen in the showings of FIGS. 2 and 5.

As best seen in FIG. 2, as the diffuser frame is moved from its lower solid line position to the upper dashed line position, the camming edge or surface 32 of each latch engages a side edge of the latch apertures 16 punched out of the horizontal and vertical surfaces 17 and 18 of the housing 11, resiliently deflecting the leg 29 inward over the latch base plate 26 until the lower end of the camming edge 32 clears the edge of the latch aperture 16 and permitting the leg 31 to snap outward away from the base plate 26 until the upper rear edge of the lower portion 34 of leg 31 abuts the edge of the latch aperture 16 with the latching edge 37 overlying the housing horizontal surface 17 adjacent to the latch aperture 16. The latching edge 37 thus prevents the diffuser frame 12 from dropping downward away from the housing.

When it is desired to release the diffuser frame 12 from the housing 11, one finger from each hand, as shown in FIG. 2, is disposed against the tab 36 on each of the spring latches 15 and pressure is exerted in the direction of the arrows shown in FIG. 2 to move the pressure-exerting fingers toward one another. This flexes the resilient legs 29 by moving the legs 31 toward the latch base plates 26 until the latching edges 37 clear the edges of the latch apertures 16. The diffuser frame 12 is now released from the housing 11 and may be moved downward to open the interior of the housing.

FIGS. 6 and 7 show enlarged details of the hinge structures at the opposite edge of the diffuser frame. The housing horizontal surface 17 and vertical side edge 18 are seen to be apertured to permit passage therethrough of the tail structure of the hinge plates 14. The hinge 14 includes a flat base 38 secured by a nut and bolt 39 flatwise upon the upper surface of diffuser frame upper horizontal leg 21, and an angularly outwardly extending part 40 turned downward from one edge of the hinge base 38, the part 40 being in turn connected to a vertically downwardly extending terminating section 41 the lower edge of which seats upon the upper surface of the housing horizontal flange 19. When the diffuser frame 12 is unlatched from the opposite edge and swung downward, the angular portion 40 of the hinge 14 moves inward through the aperture in the housing walls 17 and 18 and permits the side edge of the diffuser frame 12 to move away from the housing vertical side edge 18.

Having now described the invention in connection with a particular embodiment thereof, it will be appreciated that modifications and variations of the invention may now occur from time to time to those persons normally skilled in the art without departing from the essential scope or spirit of the invention, and accordingly it is intended to claim the same broadly as well as specifically as indicated by the appended claims.

What is claimed as new and useful is:

1. A spring latch comprising in combination, (a) a base plate for securement to a portion of the item to be releasably secured by the latch, (b) means for securing said base plate to the said item to be releasably secured, (c) a resilient leg connected to and extending substantially orthogonally in a first direction from the plane of said base plate and being resiliently deflectable toward and away from overlying relationship to said base plate, (d) a non-resilient leg connected at one end to the end of said resilient leg which is remote from said base plate and extending in a second direction opposite to said first direction through the plane of said base plate and terminating therebeyond in a manually engageable actuator, (e) a latching element carried by said non-resilient leg at a point intermediate the ends thereof, whereby, said actuator is actuatable to move said non-resilient leg and said latching element carried thereby transversely to said base plate and thereby resiliently deflect said resilient leg, release of said actuator causing reverse movement of said non-resilient leg and latching element with respect to said base plate through the resilient counter deflection action of said resilient leg.

2. A spring latch as defined in claim 1 further including a camming element carried by said non-resilient leg, said camming element being effective to cause the same mechanical movement as said actuator when said camming element is engaged by a camming element actuator.

3. A spring latch as defined in claim 1 wherein said means for securing said base plate to the said item to be releasably secured includes means for non-rotatably securing said base plate.

4. A spring latch as defined in claim 1 wherein said latching element is located on the same side of the plane of the base plate as is located the said resilient leg.

5. A spring latch as defined in claim 1 wherein said resilient and non-resilient legs are substantially planar and each of a width and length many times the thickness of the material of which they are formed, the plane of the said resilient leg being substantially orthogonal to the plane of said non-resilient leg.

6. A spring latch as defined in claim 1 wherein said non-resilient leg is non-resilient at least in the plane of resilience of said resilient leg.

7. A spring latch as defined in claim 1 wherein said resilient leg is non-resilient in at least one plane orthogonal to its plane of resilience.

8. A spring latch as defined in claim 1 wherein said non-resilient leg is non-resilient at least in the plane of resilience of said resilient leg, and wherein said resilient leg is non-resilient in at least one plane orthogonal to its plane of resilience.

9. A spring latch as defined in claims 1, 2, 4, 5, 6, 7 or 8 wherein all of said base plate, resilient leg, non-resilient leg and latching element are unitarily formed from a single piece of constant thickness material.

* * * * *